US005326011A

United States Patent [19]

Mager et al.

[11] Patent Number: 5,326,011

[45] Date of Patent: Jul. 5, 1994

[54] REDUCED-SKEW WEB DRIVE BETWEEN ROLLERS OF DIFFERING COEFFICIENTS OF FRICTION, PARTICULARLY TO TRANSPORT PAPER, METAL OR FILM IN A LASER IMAGER

[75] Inventors: Donald V. Mager, Mendota Heights; Daniel A. Baker, Minnetonka, both of Minn.

[73] Assignee: Printware, Inc., St. Paul, Minn.

[21] Appl. No.: 7,601

[22] Filed: Jan. 22, 1993

[51] Int. Cl.[5] ..... B41J 15/00

[52] U.S. Cl. ..... 226/181; 226/189; 400/636

[58] Field of Search ..... 226/181, 182, 187, 186, 226/199, 189; 400/636, 637, 637.3

[56] References Cited

U.S. PATENT DOCUMENTS

| | | | |
|---|---|---|---|
| 3,107,957 | 10/1963 | Batlas et al. | 226/181 X |
| 3,292,444 | 12/1966 | Bentley | 226/181 X |
| 3,310,214 | 3/1967 | Nesin | 226/181 |
| 3,402,868 | 9/1968 | Hammond | 226/181 X |
| 4,053,092 | 10/1977 | Edwards | 226/181 X |
| 4,544,253 | 10/1985 | Kümmerl | 226/190 X |
| 5,221,035 | 6/1993 | Suzuki et al. | 226/181 |

FOREIGN PATENT DOCUMENTS

| | | | |
|---|---|---|---|
| 0104863 | 6/1983 | Japan | 226/190 |

*Primary Examiner*—Daniel P. Stodola
*Assistant Examiner*—Paul T. Bowen
*Attorney, Agent, or Firm*—William C. Fuess

[57] ABSTRACT

A web of material, typically paper, metal or film and most commonly roll photographic plate material, passes between a first, driven, roller made from material with a high coefficient of friction, typically neoprene rubber, and a second, driven, roller made from material with a low coefficient of friction, typically metal or nylon. The high-friction drive roller (only) is positionally adjustable. The web is driven straight ahead, without appreciable undesirable steering or skew, over a broad range of adjustments of the separation, and the parallelism, between the two rollers. The web motion is responsive substantially to only the high-friction drive roller, and the web speed may accordingly be regulated, including so as to be maintained highly uniform, in response to the drive roller (only).

19 Claims, 6 Drawing Sheets

REDUCED-SKEW WEB DRIVE BETWEEN ROLLERS OF DIFFERING COEFFICIENTS OF FRICTION, PARTICULARLY TO TRANSPORT PAPER, METAL OR FILM IN A LASER IMAGER

BACKGROUND OF THE INVENTION

1. Field of the Invention

The present invention generally concerns the improved drive, or transport, of webs between opposed rollers. The present invention particularly concerns a straight transport between opposed rollers of a paper, metal or film media, including large film plates, within a laser imager. During the improved transport undesirable steering and skew, and susceptibility to mechanical tolerances and adjustments, are beneficially reduced.

2. Description of the Prior Art

Many materials processing and handling tasks require driving a continuous roll or web of a material between rollers. Such tasks include the movement of paper, metal or film material between rollers in film imagesetters and platesetters used in the graphic arts.

Particularly during transport of a paper, metal or film media in imagesetters and platesetters, each medium must typically be driven as straight as possible, with the axis of web travel continuously perpendicular to the rollers' axis. In this manner images may be accurately positionally recorded on the medium.

The state of the art in the drive of webs of paper, metal or film within laser imagesetters and platesetters is a pair of opposed rollers consisting of a driven roller and an idler roller. Both rollers are typically made of a material with a high coefficient of friction such elastomeric synthetic rubber. One roller is typically located above the web material and the other below.

In this arrangement several mechanical relationships and alignments are very critical. If appropriate relationships and alignments are not maintained then the web that is driven between the rollers will tend to be steered, or skewed, from off its required straight path of travel, wasting the web and disrupting production. Each roller must be a cylinder rotating about a central axis. Even the slightest imperfection or contamination on the surfaces of the rollers tends to degrade both these requirements, causing that the cylindrical roller should effectively exhibit a diameter which is, at least regionally, both (i) non-uniform and, simultaneously, (ii) slightly eccentric about its axis of rotation.

It is further useful that the speed of the web should be maintained as uniform as is possible. This is because, in a laser imagesetter or platesetter, the medium of the web is being imaged in and upon successive image lines by a scanning light beam. The successive image lines are typically very close together, as many as 1200 per inch and more. The human eye is very sensitive to variations in grey tones, and image discontinuities, that result when successive lines, or regions of lines, are either relatively closer together, or relatively further apart, than are other line regions.

Many strategies exist to maintain the medium in constant uniform motion past the laser marking station of the imagesetter or platesetter, thereby to image the successive lines at a constant and uniform separation. The strategies may involve a high inertial mass in the drive mechanism relative to the mass of the moved, and imaged, web. Alternatively, a dynamic feedback control of the positional drive of the web may be employed. Regardless of the means by which precisely uniform motion is imparted to the web, the ultimate drive of the web is by frictional contact between the web and each of two opposed rollers. If the friction between the web and either, or both, of the rollers varies ever so slightly during the course of imaging—which may be common with minute changes in temperature, vibration, air drafts, contamination, etc.—then minute variations in speed may be imparted to the web. Nonetheless that these speed variations are minute, they are visually detectable in high quality images, and are thus undesirable.

Opposed rollers for web drive must be maintained substantially parallel, and, also, at a distance of separation appropriate to produce a desired compressive force against the web. The compressive force must typically be adjusted in order to account for (i) variations in the friction presented by surface(s) of the two sides of the medium and/or the two rollers, and/or for (ii) for wear in the bearings and/or the drive mechanism of either or both rollers. The adjustment of compression force is accomplished by mechanically adjusting and aligning the rollers, relative to a frame and to each other, in both (i) parallelism and (ii) separation.

The required alignment is commonly accomplished by positioning at least one end of each roller in two spatial dimensions. This adjustment is, in accordance with the tolerances and required exactitude of any particular system, typically fairly complex and intricate. An initial adjustment of the (i) parallelism and (ii) spacing of the rollers is typically made in accordance with visual observations and/or by the use of gauges. Then, an initial coarse adjustment having been made, the actual result of the roller spacing and alignment on web transport is typically visually observed. Further, fine, adjustments are typically required to be, and are, made in response to empirical observations. The entire procedure of successive observations and adjustments is time consuming. The quality of the ultimate alignment is uncertain, and strongly dependent upon the skill of the technician performing the adjustments and observations. The transport rollers may—depending upon the sensitivity of the system to variations, the stability of variables, and/or the required exactitude of web movement—have to be re-aligned undesirably often.

Accordingly, it would be desirable, at least in the instances of the movement of paper, metal or film webs between rollers in film imagesetters and platesetters, if any of the quality, reliability, constancy and/or maintainability of the web transport could be improved. The web would desirably be driven in a highly exact, straight, path for lengthy periods of time during such hard use of the transport rollers as induced normal wear, tear, and variation. During movement of the web the speed of movement would desirably be maintained exactingly constant. If and when alignment and/or adjustment of the web transport rollers were to be required, it would be useful if such alignments and/or adjustments were readily and easily accomplishable to a uniform accuracy and effect.

Meanwhile that the movement of paper, metal or film webs between rollers in film imagesetters and platesetters might desirably be improved, it is known that webs may be transported between opposed rollers that differ in any of innumerable characteristics. Each one of opposite rollers may be, for example, possessed of surface characteristics as suit the processing of the web surface with which it comes into contact. Such processing may include printing or embossing. It might even be hypothesized that some characteristic or characteristics of the oppositely-disposed transport rollers might facilitate, or improve, their function in the uniform, reliable and/or maintainable transport of the web. However, even if it is postulated that one or more surfaces of two opposed rollers should facilitate the transport of a web therebetween, it is uncertain how this (these) roller's(s') surface(s) should work for the particular case of a paper, metal or film medium in a film imagesetter or a platesetter. Where in the transport path should the roller(s) of improved characteristics be positioned? Where should it (they) be positioned relative to the two sides of the paper, or film? Should either, or both, rollers be adjustable, and how should it (they) be so adjusted? If frictional contact between the web and the rollers is to be maintained uniform in order that drive velocity of the web may be maintained highly constant, then how is this to be done?

Because the solution presented by the present invention to the long-persisting difficulties of transport of paper, metal or film material between rollers in film imagesetters and platesetters will be seen to be elegant, straightforward, and highly effective, there may well be a tendency, as with all simple improvements that work well, to denigrate the erudition of the solution and/or the significance of the improvement obtained thereby. However, one rebuttal to such an hypothesized diminution of the stature of the present invention might be to provide a proverbial routineer in the art with (i) an imagesetter or platesetter and (ii) a great box of rollers of diverse characteristics, a so-called box of the "prior art". Although it might well be imagined that the use in the imagesetter or platesetter of rollers of differing characteristics might have some effect upon the transport of the paper, metal or film web, it is entirely unclear as to just exactly what should be done where and how, and to what effect, in order to ensure a reliable and straight transport of the web with less susceptibility to mechanical tolerances than was presented by previous methods.

SUMMARY OF THE INVENTION

The present invention contemplates driving a web, typically a paper, metal or film web and more particularly roll photographic plate material, between two opposed rollers having dissimilar coefficients of friction. The driven roller is made of a material with a high coefficient of friction, typically rubber and more typically neoprene rubber. The non-driven roller is made of a material with a low coefficient of friction, typically metal or nylon.

The differing coefficients of friction induce the web to reliably travel in a straight path, and in a direction perpendicular to the axis of rotation of (most particularly) the driven roller. The web drive is substantially insensitive to mechanical alignment (misalignment) of the non-driven roller, and, accordingly, typically only the high-friction drive roller is adjustable in position, facilitating ease of alignment. The speed of the driven web is substantially determined, and may beneficially be set, by only the high-frictional-coefficient drive roller. Any inconstancy in rotational speed or relative diameters, or any lash, between the two rollers such as may be due to normal environmental and mechanical variations has an insubstantial effect on the uniformity and constancy of web motion, which is, by and large, a function of only the driven roller.

The principle of the present invention wherein one roller has and presents a relatively high coefficient of friction to a driven web while another roller has and presents a relatively low coefficient to the same web may also be extrapolated to several pairs of opposed rollers that simultaneously contact a single web for the purpose of its transport. It is normally the case that only one, or a few, rollers out of a multiplicity of rollers will exhibit the high coefficient of friction; the remaining rollers, including pairs of rollers, exhibiting a low coefficient of friction.

In one of its preferred applications the present invention is embodied in an apparatus that serves to drive a web consisting of a medium that may be marked through an imager that serves to mark the medium. The preferred drive apparatus includes a frame and a first roller rotationally mounted to the frame. The first roller has a surface made of a first material having a relatively higher coefficient of friction, normally neoprene rubber. A second roller is rotationally mounted to the frame in a position opposed to the first roller so that the web may pass between it and the first roller. The second roller has a surface made of a second material having a relatively lower coefficient of friction, normally nylon or metal.

A drive, typically an electric motor or the like, drives the first roller (only) in rotation. The web passes between the first and the second rollers and is driven in position by the first roller serving as the primary frictional drive and directional control roller. The web is pressed against into position against the first roller by the second roller.

DESCRIPTION OF THE PREFERRED EMBODIMENT

The present invention is embodied in a web drive mechanism based on two opposed rollers having dissimilar coefficients of friction. Specifically, at least the surface of the driven roller is made of a material having a relatively high coefficient of friction while at least the surface of the non-driven roller is made of a material having a relatively low coefficient of friction.

Figure 1:
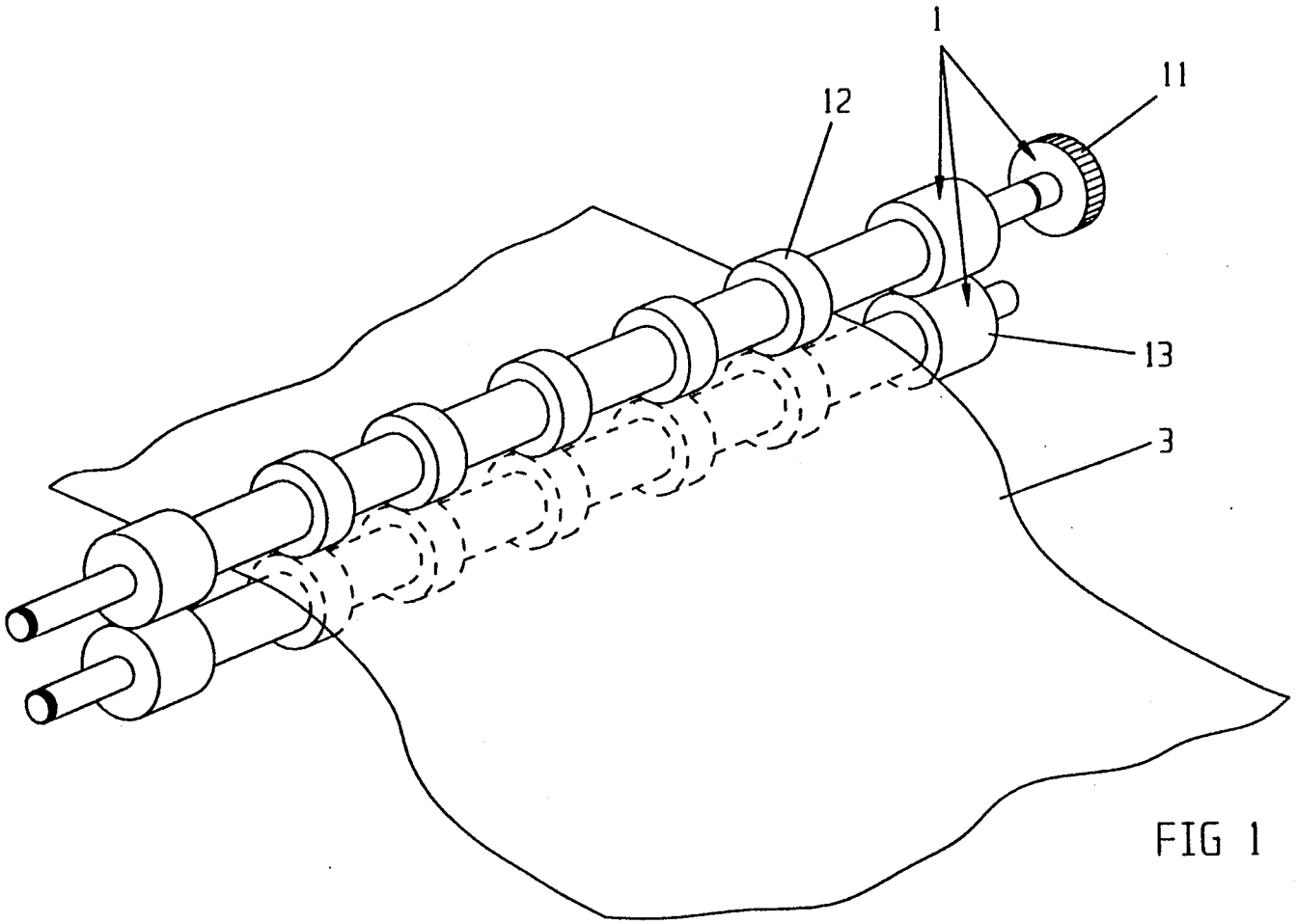
FIG. 1 is a simplified diagramnatic view of a driving, and a driven, roller having differing coefficients of friction, thereby to illustrate the principle of the present invention.

The principles of the present invention are illustrated in FIG. 1. A web 3 of flexible material (shown in phantom line for being the work piece, and not part of the present invention) is transported by the drive mechanism 1 in accordance with the present invention. The drive mechanism 1 includes a motor 11 and two rollers 12, 13. At least the surface of the driven roller 12 is made of a material with a high coefficient of friction such as neoprene rubber. At least the surface of the non-driven roller 13 is made of a hard, slippery with a low coefficient of friction such as nylon or metal. The non-driven roller 13 serves to force the web 3 against the driven roller 12 so that frictional force causes the web 3 to advance. Because the coefficient of friction is much higher on the driven roller 12 than the non-driven roller 13, all adjustment and alignment is preferably performed only on driven roller 12, as will later be shown in conjunction with FIG. 4.

Figure 2:
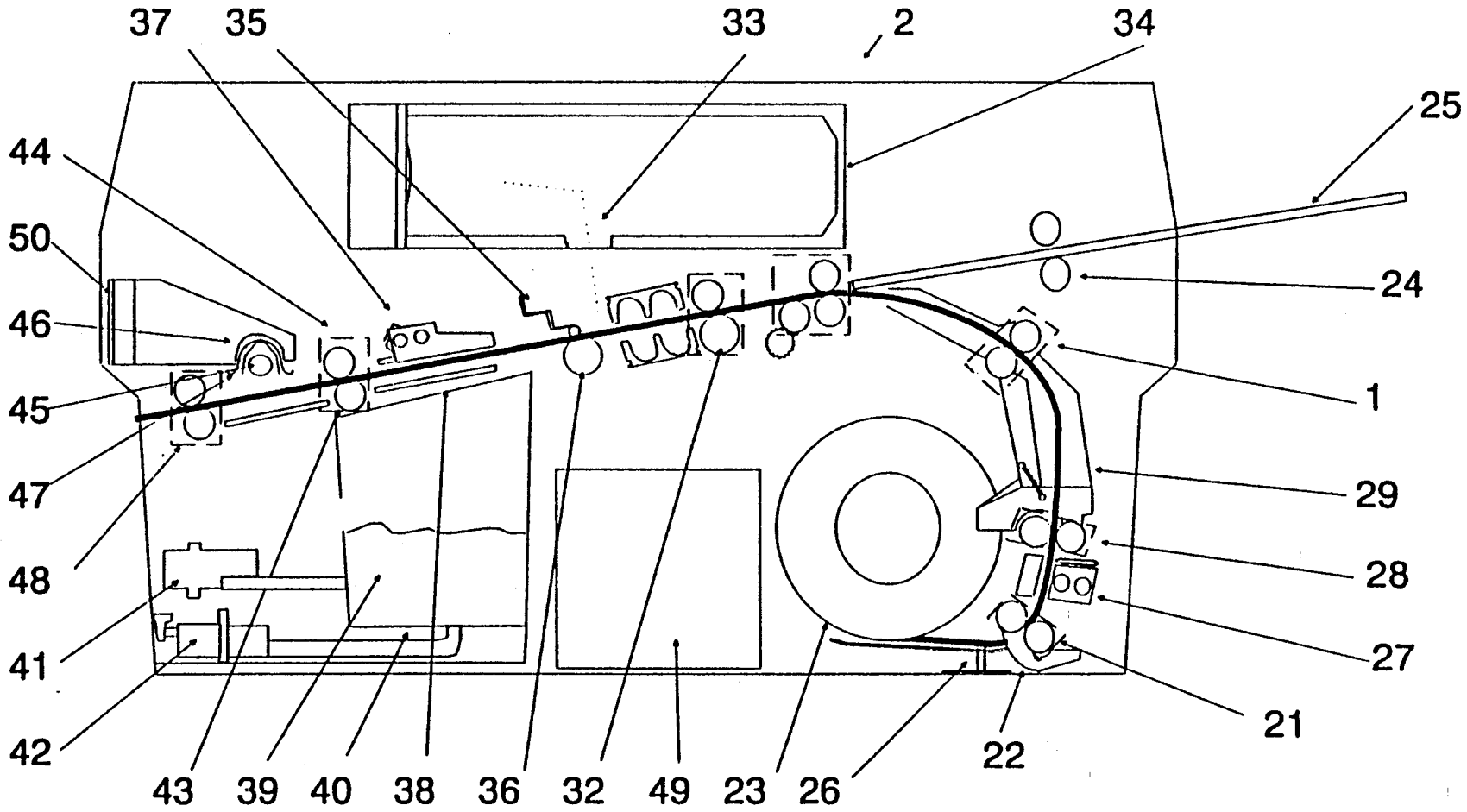
FIG. 2 is a diagrammatic plan view of an electrophotographic imager equipped with the drive roller mechanism of the present invention.

A diagrammatic plan view of an exemplary electrophotographic imager 2 that is equipped with the drive mechanism of the present invention is shown in FIG. 2. The roller drive mechanism 1 (shown in FIG. 1) in accordance with the present invention serves as the transfer rollers 1 of the electrophotographic imager 2. The roller drive mechanism 1, serving as transfer rollers 1, is, as will be explained, critical to passing a medium that is imaged by the electrophotographic imager 2 through the imager 2 in a straight line, and without skewing, at a constant speed.

In operation of the electrophotographic imager 2, an externally-generated print job command is received, normally from a computer (not shown). Plate infeed rollers 21—maintained in position by a release lever 22—pull a rolled medium (not shown) off a plate material roll 23 or else decurl rollers 24 straighten sheet material (not shown) received via load slide 25. A plate guide 26 guides the movement of the rolled medium (not shown). When an appropriate length of the rolled medium has been fed by the plate infeed rollers 21, a sheet is cut by cutter assembly 27. Each resulting sheet is fed further onwards by feed rollers 28, transfer plate assembly 29, and transfer rollers 1. Finally the marker transport roller 36 engages and pulls the plate material (not shown) under the charge coronas 32.

When the plate material (not shown) passes through the charge coronas 32 a negative electrical charge is placed on its side that is to be imaged. A laser light beam 33 (shown in dotted and dashed line for being physically intangible) that is produced by a marker unit 34 strikes the plate material below the aperture 35. The plate material (not shown) is selectively discharged in the areas exposed by the laser light 33. The laser "writes white".

The exposed plate material is fed onwards by marker transport roller 36. As the plate material passes between the top applicator plate 37 and the bottom applicator plate 38 a developer solution containing toner 39 from developer/toner reservoir 40 is applied in a developer/-toner "bath". The liquid developer/toner is flow communicated (by a conduit not shown) to this area under force of developer/toner pump 41. Meanwhile, the uniformity of the mixture of toner and liquid carrier is assured by agitator pump 42. The toner particles within the developer solution are subject to the electric fields of the applicator plates—consisting of the top applicator plate 37 and the bottom applicator plate 38—and the electrostatically charged photoconductive surface of the medium (not shown). Responsively to these electric fields, particles of toner are attracted, or electrostatically precipitated, out of the mixture of the developer solution, and are attracted to those undischarged, latent electrostatic charge image, areas of the medium's photoconductive surface that have retained a large negative electrical charge.

The squeegee rollers 43 and squeegee wiper bar 44 remove excess developer solution—depleted in toner by action of the adherence of a portion thereof to the plate material—from the plate material and recycle it back to developer/toner reservoir 40. A hot fuser bulb 45 is partially shielded by baffle 46 and fuser guard 47. Its directed energy serves to fuse the toner to the plate material, and to dry the plate material. The dried and fused plate material then exits the electrophotographic imager 2 through the exit rollers 48. Necessary air circulation for cooling is maintained by main fan 49 and a number of exit fans 50.

Each individual one of the several sets of rollers shown in FIG. 2 either does, or does not, embrace the principles of the present invention in accordance whether (i) it is, or is not, important that the web should undergo precision steering and velocity control in the region of the rollers, and (ii) if the web is to so undergo precision control, then which particular set of rollers should impart this control? Each roller of the pair of plate infeed rollers 21, decurl rollers 24, feed rollers 28 and exit rollers 48 is typically an unsegmented roller having and presenting a contiguous surface of rubber. This is in because the principles of the present invention for precision steering, and velocity control, of the web are substantially irrelevant to these rollers, which are primarily concerned with loading the web into electrophotographic imager 2 or, in the case of exit rollers 48, extracting the web from the imager 2.

As already explained, the transfer rollers 1 are in accordance with the present invention, the uppermost such roller (as shown in FIG. 2) being the driven roller 12 (shown in FIG. 1) having a surface material with a high coefficient of friction, preferably neoprene rubber, while the lowermost such roller (as shown in FIG. 2) is the non-driven roller 13 (shown in FIG. 1) having a surface made of a hard, slippery with a low coefficient of friction, preferably nylon. Note that the high-friction, uppermost, roller of the transfer rollers 1 is on the outside of the arc through which the web is bent in its path through the electrophotographic imager 2. This position is preferred.

A pair of rollers (not numbered) at the base of the load slide are preferably both nylon, with segmented surfaces. Commensurate with the primary control of the web movement under the control of the driven one (roller 12 as shown in FIG. 1) of the transfer rollers 1, and also the subsequent web motion control next to be explained, it might well be guessed that this pair of rollers is intended to have little effect on the web direction, or speed. This is indeed the case.

Still another, next, pair of opposed rollers (not numbered) exists in the region of charge coronas 32. The uppermost one of these rollers typically has a segmented (i.e., non-contiguous) surface of nylon. The lowermost one of these rollers is the only driven roller of the pair, and typically has and presents a surface of rough metal. Herein an interesting condition is presented. A roller pair in a region where precise web positional, and speed, control is desired does not (directly) use the principle of the invention. The reason that this is so is because marker transport roller 36 preferably has and presents a high friction, rubber, surface. It is thus this roller that, in substantial part, controls the direction, and speed, of the web drive in the region of the imaging laser light beam 33.

Finally, the squeegee rollers 43 comprise yet another roller pair making direct use of the principles of the present invention. The uppermost one of squeegee rollers 43 preferably has and presents a high-friction segmented rubber surface. The lowermost one of squeegee rollers 43 preferably has and presents a low-friction segmented metal surface. Note that the high-friction, uppermost, one of squeegee rollers 43 is on the opposite side of the web medium to the high-friction marker transport roller 36. Such an arrangement is used when, responsive to the origin and direction of skewing forces exerted on the moving web, the positional control of the moving web to counter these forces is better passed from a high-friction roller on one side of the web to a high-friction roller on the other side of the web.

Due to a profusion of direct and indirect, grouped and isolated, directly opposed and indirectly opposed combinations of high- and low-friction rollers within the electrophotographic imager 2 shown in FIG. 2, it might, but for the explanation of the principle of the present invention, to see any unifying method, or theme, regarding the juxtaposition of the various rollers, and the choices of the frictional resistance that is presented by their various surfaces. A basic design approach to web transport in accordance with the present invention is to control the position, and speed, of the moving web at crucial points along its path by opposition of rollers having and presenting surfaces with differing coefficients of friction. Whether rollers, and roller pairs, outside these regions are to be low friction (i.e., metal surfaced), high friction (i.e., rubber surfaced) of combinations of low- and high-friction surfaces basically depends on what is attempting to be done with the web at the location of each roller. Gross movement, and strong rudimentary positional control, of the web is accomplishable by opposed rollers both of which present high frictional resistance. Conversely, light positional guidance to the web (especially in an axis orthogonal to the plane of the web) is accomplishable by opposed rollers both of which present low frictional resistance.

Figure 3:
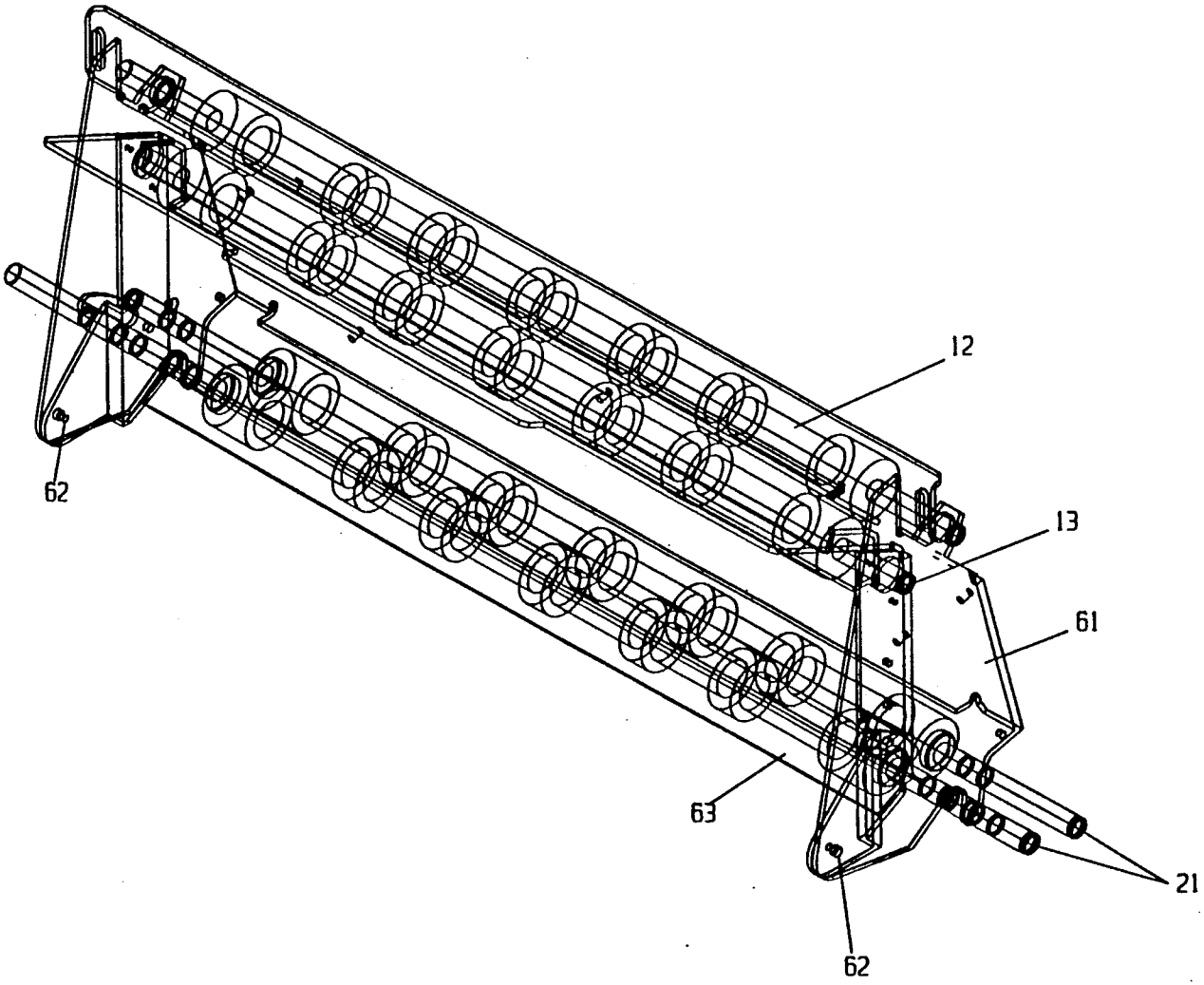
FIG. 3 is a perspective view of that part of the frame of the electrophotographic imager, previously seen in FIG. 2, that supports the rollers having differing coefficients of friction, previously seen in FIG. 1.

A perspective view of a part of the frame of the electrophotographic imager 2 (previously seen in FIG. 2) that supports the rollers 12, 13 (previously seen in FIG. 1) having differing coefficients of friction is shown in FIG. 3. The rollers 12, 13 are not shown in FIG. 3, which suggests their positions only in phantom line. The frame portion 61 that supports the upper roller 12 (in a manner to be more particularly shown in FIG. 4) is hinged at hinge joint 62 to that frame portion 61 that supports the lower roller 13 (in a manner to be more particularly shown in FIG. 4). Because only the relative movement between the rollers 12, 12 is relevant to their alignment, and adjustment, either or neither frame portion 61, 62 could be fixed relative to the greater body of the electrophotographic imager 2 (previously seen in FIG. 2). The frame portion 63 is normally the only frame portion so fixed. Accordingly, frame portion 61, and upper roller 12 rotationally affixed thereto, is adjustable in separation relative to frame portion 63, and lower roller 13 rotationally affixed thereto. Notably, the plate infeed rollers 21 (shown in phantom line in FIG. 4 and previously seen in FIG. 2) are rotationally affixed to the greater body of the electrophotographic imager 2 (previously seen in FIG. 2), and are not varied in separation by adjustment between frame portions 61 and 63.

Figure 4:
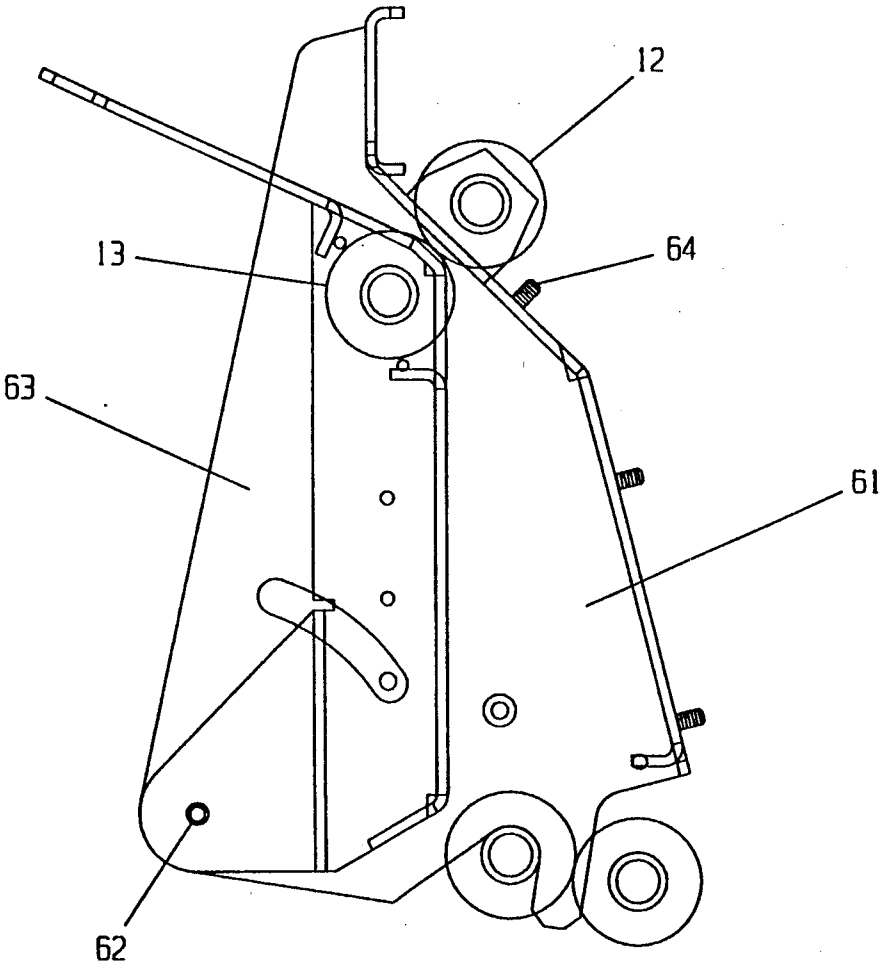
FIG. 4 is a detail end view of that part of the frame of the electrophotographic imager previously seen in FIG. 3.

A detail end view of the frame portions 61, 63 (previously seen in FIG. 3) of the electrophotographic imager 2 (previously seen in FIG. 2) is shown in FIG. 4. The frame portion 61 pivots about hinge joint 62 relative to frame portion 63 under force of variably adjustable screw 64 in order to adjust the separation of upper roller 12 relative to lower roller 13. Because the frame portion 62 is fixed to the greater body of the electrophotographic imager 2 (previously seen in FIG. 2), only the upper roller 13 is spoken of as being "adjustable".

Figure 5:
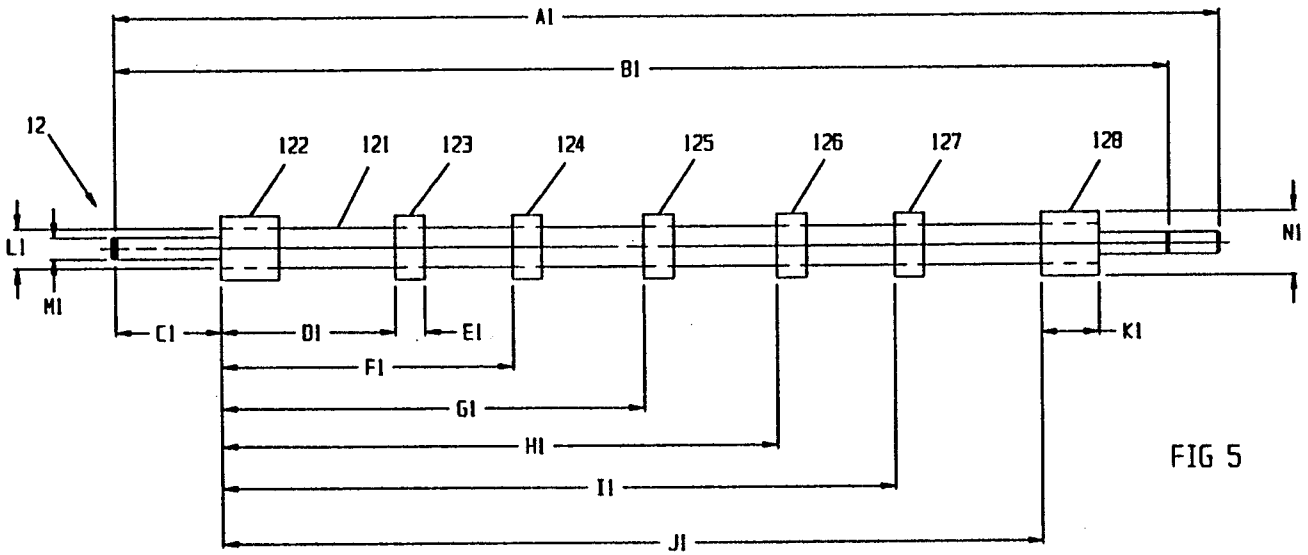
FIG. 5 is a plan view of the preferred embodiment of the drive roller of the drive mechanism in accordance with the present invention.
Figure 6:
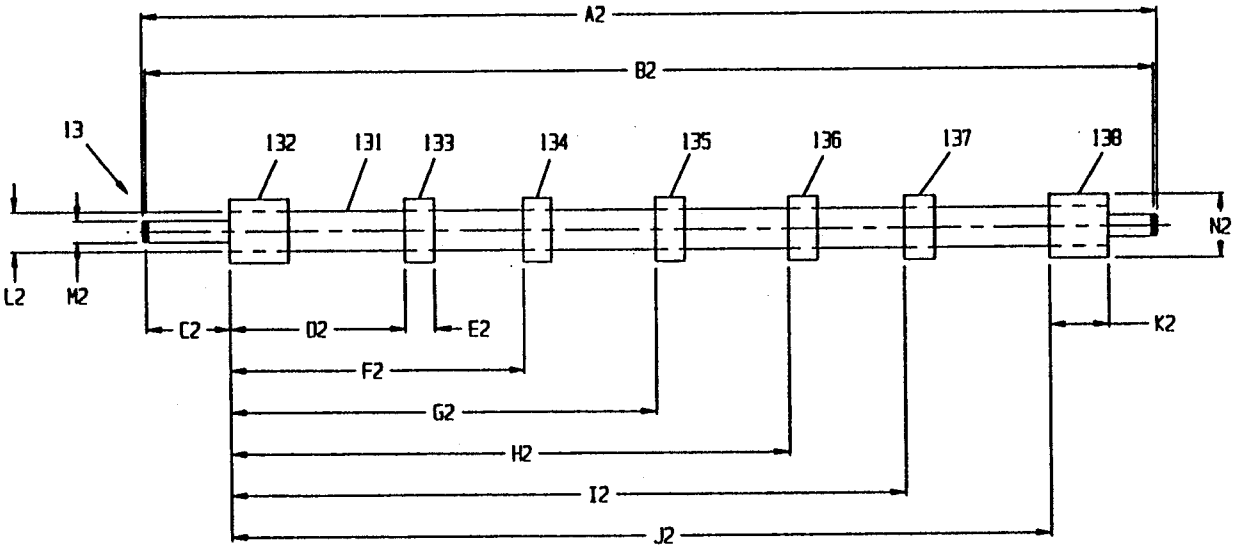
FIG. 6 is a plan view of the preferred embodiment of the driven roller of the drive mechanism in accordance with the present invention.

A preferred embodiment of the drive, upper, roller 12 of the drive mechanism 1 in accordance with the present invention is shown in plan view in FIG. 5, and FIG. 6 likewise shows a plan view of the preferred embodiment of the driven, lower, roller 13 of the drive mechanism 1 in accordance with the present invention (both rollers and mechanism previously seen in FIGS. 1 and 4). In FIGS. 5 and 6 the nominal values of the indicated dimensions is as follows:

| Figure | Dimension | Nominal Value |
|---|---|---|
| 5 | A1 | 18.91" |
| 5 | B1 | 18.022" |
| 5 | C1 | 1.825" |
| 5 | D1 | 3.000" |
| 5 | E1 | .500" (5x) |
| 5 | F1 | 5.000" |
| 5 | G1 | 7.250" |
| 5 | H1 | 9.500" |
| 5 | I1 | 11.500" |
| 5 | J1 | 14.000" |
| 5 | K1 | 1.000" (2x) |
| 5 | L1 | .688" |
| 5 | M1 | .375" |
| 5 | N1 | 1.100" |
| 6 | A2 | 17.36" |
| 6 | B2 | 17.238" |
| 6 | C2 | 1.439" |
| 6 | D2 | 3.000" |
| 6 | E2 | .500" (5x) |
| 6 | F2 | 5.000" |
| 6 | G2 | 7.250" |
| 6 | H2 | 9.500" |
| 6 | I2 | 11.500" |
| 6 | J2 | 14.000" |
| 6 | K2 | 1.000" (2x) |
| 6 | L2 | .688" |
| 6 | M2 | .375" |
| 6 | N2 | 1.100" |

The entire material of both rollers 12, 13 is chemically compatible with (i.e., inert to) ozone and isopar.

Referring to FIG. 5, the shaft 121 of upper roller 12 is preferably fabricated of 303 stainless steel. Each of the rollers 122–128 is preferably 60 durometer nitrile (neoprene) rubber.

Referring to FIG. 6, the shaft 131 of upper roller 13 is preferably fabricated of 303 stainless steel. Each of the rollers 132–138 is preferably made of nylon, but may, alternatively, be made of the same steel from which the shaft is made.

In accordance with the present invention the rubber rollers 122–128 of the driving shaft 12 have a much greater coefficient of friction than do the nylon rollers 132–138 of the driven shaft 13. This difference in friction permits that (i) the paper, metal or film medium will be driven straight ahead, without appreciable skewing, by the drive mechanism 1 (shown in FIGS. 1 and 2), and (ii) the drive mechanism 2 (shown in FIGS. 1 and 2) will have a broad range of adjustment, and be substantially insensitive to misadjustment. Such setup, or adjustment, as needs be accomplished is easily performed by turning the screws 64 (shown in FIG. 4).

In accordance with the preceding explanation, the present invention will be recognized to teach that roller, and drive roller, pairs within an imager transporting a web may usefully present surfaces of differing coefficients of friction. Other variants of the invention will suggest themselves to a practitioner of the mechanical design arts. For example, three spaced parallel rollers could be aligned so as to pass a web in a bent path. The coefficient of friction presented by the surface of each roller, driving or no, could be adjusted relative to the other rollers, and relative to the desired response of the web that is driven in position.

In accordance with the preceding explanation, the present invention should be interpreted broadly, and in accordance with the following claims only, and not solely in accordance with that particular embodiment within which the invention has been taught.

What is claimed is:

1. In an imager for marking a web of photosensitive medium with light, the imager having a plurality of pairs of opposed rollers for guiding the web through the imager with at least one roller of each pair serving to drive the web, the improvement wherein at least one of the plurality of pairs of opposed rollers comprises:

a first roller with a surface made of a first material having a predetermined coefficient of friction; and a second roller, opposed to the first roller so that the web may past between the first and the second roller, with a surface made of a second material having a coefficient of friction relatively lower than the predetermined coefficient of friction; and wherein at least three succeeding ones of the plurality of pairs of opposed rollers comprise:

a first roller pair located first in the direction in which the web is driven where the surface of the first material is disposed to a first side of the web;

a second roller pair located second in the direction in which the web is driven where the surface of the first material is disposed to a second side of the opposite to the first side; and a third roller pair located third in the direction in which the web is driven where the surface of the first material is again disposed to the first side of the web.

2. The improvement to at least one of the plurality of pairs of opposed rollers of a light imager according to claim 1 wherein the first and the second roller, jointly, constitute a roller pair that serves to drive the web.

3. The improvement to a one roller pair that serves to drive the web of photosensitive medium within a light imager according to claim 2 wherein the first roller is a drive roller; and wherein the second roller is a driven roller.

4. The improvement to at least one of the plurality of pairs of opposed rollers of a light imager according to claim 1 wherein the surface material of the first roller consists essentially of rubber.

5. The improvement to at least one of the plurality of pairs of opposed rollers of a light imager according to claim 1 wherein the surface material of the second roller consists essentially of metal.

6. The improvement to at least one of the plurality of pairs of opposed rollers of a light imager according to claim 1 wherein the surface material of the first roller consists essentially of steel.

7. The improvement to at least one of the plurality of pairs of opposed rollers of a light imager according to claim 1 wherein the surface material of the first roller consists essentially of nylon.

8. The improvement to at least one of the plurality of pairs of opposed rollers of a light imager according to claim 1 wherein the first roller is segmented, with only a portion of the surface of the web in contact with segments of the first roller.

9. The improvement to at least one of the plurality of pairs of opposed rollers of a light imager according to claim 1 wherein the second roller is segmented, with only a portion of the surface of the web in contact with segments of the second roller.

10. Multiple pairs of opposed rollers for guiding a web of photosensitive medium through an imager that serves to mark the medium with light, each pair of the multiple pairs of opposed rollers comprising:

a first roller with a surface made of a first material having a predetermined coefficient of friction; and a second roller, opposed to the first roller so that the web may past between the first and the second roller, with a surface made of a second material having a coefficient of friction relatively lower than the predetermined coefficient of friction; and succeeding ones of the multiple pairs of opposed rollers comprising:

a roller pair where the surface of the first material is disposed to a first side of the web; alternating in line with the movement of the web with a second roller pair where the surface of the first material is disposed to a second side of the web opposite to the first side.

11. The multiple pairs of opposed rollers for guiding a web of photosensitive medium in an imager according to claim 10 further comprising:

a frame to the imager; and means for driving the first roller of each roller pair in rotation relative to the frame, and to the web;

wherein the first roller serves not only to guide the web passing between it and the second roller, but also so as to drive a movement of the web.

12. The multiple pairs of opposed rollers for guiding a web of photosensitive medium in an imager according to claim 11 further comprising:

a fixed holding means for rotationally holding the second roller of at least one roller pair in fixed position relative to the frame; and a first adjustable holding means for rotationally holding the first drive roller of the at least one roller pair in an adjustably variable position relative to the frame; and a second adjustable holding means for rotationally holding the first drive roller of the at least one roller pair in an adjustably variable position relative to the second roller;

wherein adjustment in the guidance, and in the drive, of the web passing between the first and second rollers of the at least one roller pair transpires solely by adjustment of the variably positionable first roller.

13. A drive apparatus for driving a web through an imager that serves to mark the web, the drive apparatus comprising:

a frame;

a plurality of first rollers, each rotationally mounted to the frame and each having a surface made of a first material having a predetermined coefficient of friction;

a like plurality of second rollers, each rotationally mounted to the frame in a position opposed to a corresponding first roller so that the web may past between the first and the second roller and each having a surface made of a second material having a coefficient of friction relatively lower than the predetermined coefficient of friction; and drive means for driving the first roller in rotation;

wherein the opposed first and the second rollers alternate on the side of the web to which each is disposed;

wherein the web passing between the first and the second rollers is driven in position by each first roller serving as a drive roller, and is pressured into contact with each such first roller by the corresponding second roller;

wherein the web driven in position by first rollers that are first disposed to a one side of the web, and that are next disposed to an opposite side of the web, in alteration.

14. The drive apparatus according to claim 13 further comprising:

means for adjusting at least one first roller in position relative to the frame; and means for adjusting the at least one roller in position relative to the second roller.

15. The drive apparatus according to claim 14 wherein the surface material of at least one first roller consists essentially of rubber.

16. The drive apparatus according to claim 15 wherein the surface material of at least one second roller consists essentially of metal.

17. The drive apparatus according to claim 15 wherein the surface material of at least one second roller consists essentially of nylon.

18. The drive apparatus according to claim 14 wherein at least one first roller is segmented along its length, with only a portion of the surface of the web in contact with segments of the at least one first roller.

19. The drive apparatus according to claim 14 wherein at least one second roller is segmented, with only a portion of the surface of the web in contact with segments of the at least one second roller.

* * * * *